United States Patent [19]

Deutsch

[11] 4,145,946

[45] Mar. 27, 1979

[54] SUSTAINED REPEAT CONTROL DIGITAL POLYPHONIC SYNTHESIZER

[75] Inventor: Ralph Deutsch, Sherman Oaks, Calif.

[73] Assignee: Kawai Musical Instrument Mfg. Co., Ltd., Hamamatsu, Japan

[21] Appl. No.: 712,745

[22] Filed: Aug. 9, 1976

[51] Int. Cl.[2] ..... G10H 1/04

[52] U.S. Cl. ..... 84/1.26; 84/1.12; 84/1.13; 84/1.21; 84/1.27; 84/1.24

[58] Field of Search ..... 84/1.01, 1.03, 1.13, 84/1.17, 1.12, 1.24, 1.26, DIG. 4, 1.21, 1.27

[56] References Cited

U.S. PATENT DOCUMENTS

| | | | |
|---|---|---|---|
| 3,610,799 | 10/1971 | Watson | 84/1.26 X |
| 3,610,805 | 10/1971 | Watson et al. | 84/1.26 X |
| 3,610,806 | 10/1971 | Deutsch | 84/1.13 X |
| 3,821,458 | 6/1974 | Schreier | 84/1.26 X |
| 3,910,150 | 10/1975 | Deutsch et al. | 84/1.03 |
| 3,952,623 | 4/1976 | Deutsch | 84/1.26 X |

*Primary Examiner*—Ulysses Weldon
*Attorney, Agent, or Firm*—Christie, Parker & Hale

[57] ABSTRACT

A sustained repeat control in a digital polyphonic synthesizer for gradually decreasing the amplitude of one or more notes generated repetitively in response to operation of a single key. The sustained repeat control includes a digital register storing a plurality of control words in digitally coded form, there being one control word assigned to each note being generated at any one time. Each word includes bits coded to indicate the current relative amplitude of the associated note. When a key is depressed, the control word or words for the note or notes assigned to that key have bits initialized to a predetermined value. When the key is released the amplitude values represented by the bits are counted down periodically. The bits in turn control the amplitude of the repetitively generated notes, a zero detector terminating the operation when the bits are decremented to zero.

4 Claims, 2 Drawing Figures

SUSTAINED REPEAT CONTROL DIGITAL POLYPHONIC SYNTHESIZER

FIELD OF THE INVENTION

This invention relates to digital tone synthesizers, and more particularly, to a circuit for sustaining notes forming repetitive patterns after release of the key initiating the notes.

BACKGROUND OF THE INVENTION

One of the effects provided in conventional electronic organs is the ability to generate a repeat feature in which a single note, or two notes at some predetermined interval, such as an octave, are played repetitively by depressing a single key. The repeat pattern continues as long as the key is depressed. In connection with the repeat function, it is desirable to provide the musician the option of having a short or a long release time for the repetitive function. With a long release time or "sustain" it is necessary to force the repeat function to continue after the key is released while the overall amplitude of the individual notes are gradually reduced. In U.S. Pat. No. 3,910,150 there is described an arrangement for providing an octave repeat with a sustained interval subsequent to key release in a computer organ. The computer organ described in the patent has tone generators which compute in real time the amplitude of successive sample points of a musical wave shape.

The present invention is directed to an arrangement for providing a sustained repeat function in a digital organ of the type described in copending application Ser. No. 603,776, filed Aug. 11, 1975, entitled "Polyphonic Tone Systhesizer", now issued as U.S. Pat. No. 4,085,644.This application describes a digital computer organ having a plurality of tone generators, each tone generator including a computation mode in which data defining the relative amplitudes of a plurality of sample points of the desired musical wave shape are calculated. This data is then converted to an analog voltage having a fundamental frequency corresponding to the pitch of the key to which the note generator is assigned. A circuit for detecting operation of the individual keys and assigning note generators to those keys is described in copending application Ser. No. 619,615, filed Oct. 6, 1975, entitled "Keyboard Switch Detect and Assigner" issued as U.S. Pat. No. 4,022,098. The waveshape of a particular tone generated by a tone generator is in turn controlled by an envelope generator of the type described in copending application Ser. No. 652,217, filed Jan. 26, 1976, entitled "ADSR Envelope Generator", now issued as U.S. Pat. No. 4,079,650.

The present invention is directed to an improvement in the tone synthesizer of the type described in these copending applications, and particularly provides a modification to the ADSR amplitude generator by which the overall amplitude of successive notes produced by one or more tone generators are gradually reduced down to zero over a controlled period of time.

This is accomplished, in brief, by providing a register for storing amplitude information for each tone generator. When a tone generator is assigned to a key, an initial amplitude valve is stored in the register. If the key has initiated a Repeat function in which the note is repeatedly played or played alternately with a second note, the circuit senses when the key is released and decrements the amplitude value stored in the resigter for that note each time the note is repeated following the release. When the amplitude value is reduced to 0, the tone generator is released for assignment to another key. The amplitude information from the register is applied to a digital-to-analog converter which generates a corresponding voltage which steps down in increments as the digital value is decremented. This step function voltage is used to control the overall amplitude of the audio signal and hence the loudness of the note on each successive playing of the note after the key is released.

DESCRIPTION OF THE DRAWINGS

Referring to the drawings in detail.

DETAILED DESCRIPTION

Figure 1:
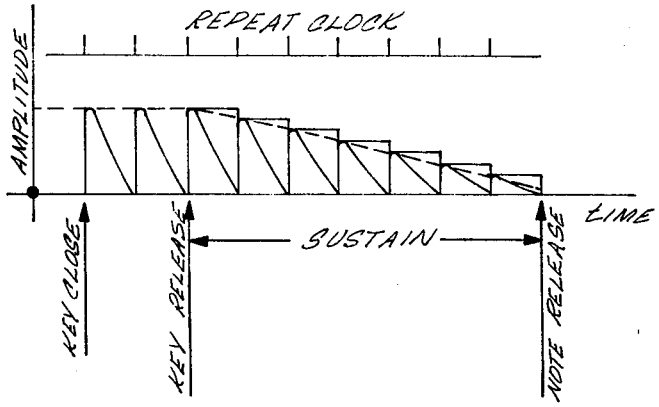
FIG. 1 is a time diagram useful in explaining the operation of the invention.

The following description incorporates by reference the disclosures in the above-identified three pending applications. The corresponding reference characters have been used herein to identify identical circuit elements found in the copending applications.

Referring to the timing diagram of FIG. 1, the waveshape of the envelope of a succession of notes is shown. These notes are repeated periodically in synchronism with a Repeat clock. The waveshape of the envelopes corresponds to a percussive type note in which the amplitude of the envelope rises abruptly during the attack and decays immediately back to zero amplitude. As long as the key remains closed, the notes are repeated at time intervals determined by the Repeat clock, the peak amplitude of the envelope remaining constant. The manner in which one or more notes are repeatedly generated by depressing a single key is described in copending application Ser. No. 712,744, filed Aug. 9, 1976, entitled "Interval Repeat" and assigned to the same assignee as the present application. Successive notes may be of the same pitch or alternate at two different pitches, such as an octave apart. During a "sustain" period after the key is released, the notes are continued to be generated at the Repeat clock rate, but the overall amplitude of the successive notes is reduced gradually until the amplitude reached zero, at which time the associated note generators are released for assignment to other keys. "Sustain" is used herein to denote a long release.

Figure 2:
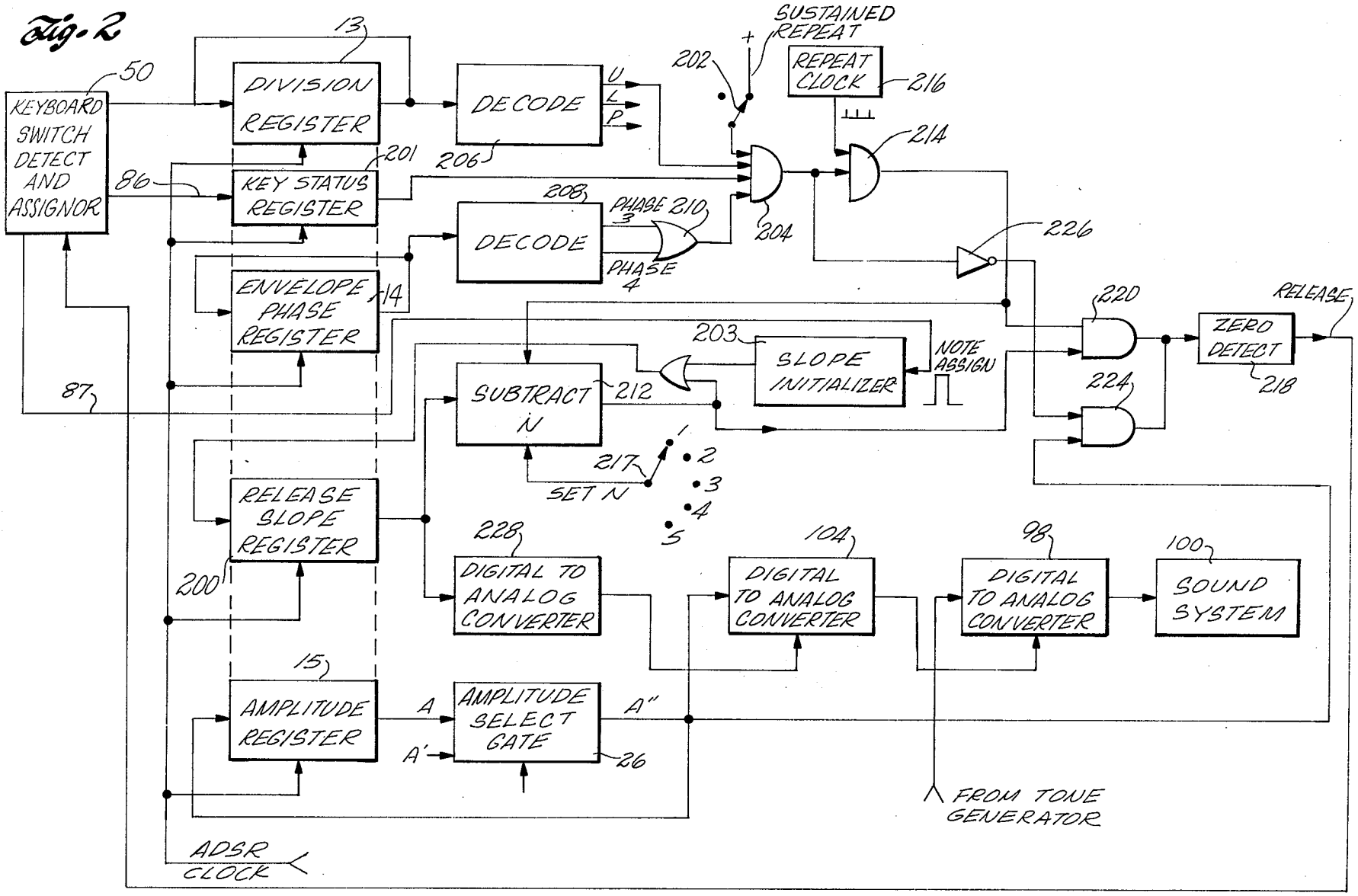
FIG. 2 is a block diagram of the circuitry employed with the synthesizer to provide the features of the present invention.

The circuit of FIG. 2 shows the control by which the amplitude of successive notes during the "sustain" period is gradually reduced. The overall amplitude of the envelope of each note being generated in response to keys that have been depressed is controlled by data stored in a Release Slope register 200. The Release Slope register stores a plurality of words in digitally coded form, there being one word for each tone generator of the synthesizer. While any number of tone generators may be provided, typically twelve generators have been considered adequate for an electronic organ, allowing one key per finger plus a pedal for each foot to be played simultaneously without exceeding the capacity of the organ. The Release Slope register stores the amplitude factor for each assigned tone generator. A Slope Initializer 203 stores a constant in the Release Slope register for each control word at the time the associated tone generator is assigned to a key.

Associated with the Release Slope register is a Division register 13 and an Envelope Phase register 14, both of which also have capacity for storing one word per tone generator in the system. The Division register 13 and Envelope Phase register 14 correspond to the Division shift register and Envelope Phase shift register described in the above-identified application Ser. No. 652,217 and form part of the ADSR envelope generator. The Division register 13 is loaded from a Division counter described in pending application Ser. No. 619,615 and forms part of the keyboard switch detect and assignor circuit 50. A Key Status register 201 is also provided which stores a status bit for each of the twelve tone generators. The status bit is set to 1 when a key is depressed and a tone generator is assigned and set to 0 when the key is released. To this end the register 201 receives a key assignment signal over input line 87 and a key release signal over input line 86 from the key switch detect and assignor circuit. Control of lines 86 and 87 is described in detail in application Ser. No. 619,615. The Envelope Phase register 14 stores information defining the envelope phase for each tone being generated. As described in application Ser. No. 652,217, the envelope for each note is divided into six successive phases for computational purposes, phases 1 and 2 corresponding to the leading edge or "attack" portion of the note, phases 3 and 4 corresponding to a trailing edge or "decay" portion of the note immediately following the attack phases 1 and 2. Phases 5 and 6 are only involved where the note is sustained after release of the key even for a short time. Since the Repeat function is generally only employed with percussive type notes which decay to zero independently of key release, phases 5 and 6 can be ignored for the purpose of the present description.

The Division register 13, Envelope Phase register 14, Release Slope register 200 and Key Status register 201 are preferably in the form of shift registers and are shifted in synchronism from the ADSR clock in the ADSR envelope generator described in application Ser. No. 652,217. Thus the information as to the keyboard division, the envelope phase, the status of the key switch, and the current amplitude factor for each key up to twelve keys depressed at any one time, is available at the output of the registers 13, 14, and 200 and 201 in a repetitive sequence.

When a Sustained Repeat function is desired, a switch 202 is set, providing a binary 1 level to one input of an AND gate 204. Since the Sustained Repeat function is generally restricted to notes played by the upper keyboard, the output of the Division register 13 is decoded by a Decode circuit 206 which provides a binary 1 level to a second input of the AND gate 204 when an upper division note control word is read out of the Division register 13. A third input to the AND gate 204 is derived from the Envelope Phase register 14 through a Decode circuit 208 which signals a binary 1 on either of two outputs when the phase 3 or phase 4 condition for the corresponding note is indicated by the output of the Envelope Phase register. These two outputs are coupled through an OR gate 210 to a third input of the AND gate 204. A fourth input to the AND gate 204 is derived from the Key Status register 201. Thus the output of the AND gate 204 goes to 1 whenever the Sustained Repeat function is set, the control words associated with a particular note indicate the note is in the upper division, the envelope of the note is in a phase 3 or phase 4 state, and the associated key has been released.

At the same time, the amplitude factor associated with the same note is read out of the Release Slope register and applied to a Subtract circuit 212 which decrements the amplitude factor by subtracting an amount N. The Subtract circuit is activated in response to a control signal derived from the output of an AND gate 214. The AND gate 214 senses that the output of the AND gate 204 is true. The output pulses from the Repeat clock, indicated at 216, are also applied to the input of the AND gate 214 so that an output is derived from the AND gate 214 only when the Repeat clock indicates that the next note in the repeat cycle is being initiated. At this point in the operation the amplitude factor from the Release Slope register 200 is decremented by an amount N by the Subtract circuit 212 and stored back in the Release Slope register 200. The decrement value of N may be set to any one of a plurality of values. Providing an input to a subtract circuit with any one of a plurality of discrete values N is well known in the computer art. For example, the control of the value N may be provided by using a multiple pole switch 217, shown, by way of example in FIG. 2, as selecting one of five values of N, as indicated at 1, . . . 5. The input signals representing the values of N selected by the switch 217 may be coded in any well known manner as required by the particular subtract circuit used. For example, for the digital system of the preferred embodiment the signals selected by the switch 217 as inputs are binary coded voltages representing the values 1, . . . 5. Such electrical coding of digital values is well known to the computer art. The particular manner in which the values of N are electrically coded is not material to the present invention. The value of N of course controls the amount the amplitude factor for a given note is decremented each time and therefore in conjunction with Repeat Clock 216 determines the rate at which the amplitude factor is reduced to zero from its initial value.

When the amplitude factor for a particular note is reduced to zero by the Subtract circuit 212, this fact is sensed by a Zero Detect circuit 218 which decodes the output from the Subtract circuit 212. An AND gate 220 couples the output of the Subtract circuit 212 to the Zero Detect circuit 218 in response to the output from the AND gate 214. Thus the Zero Detect circuit responds to the output of the Subtract circuit 212 only for those notes being decremented during the Sustained Repeat operation. The output of the Zero Detect circuit is coupled to the assignment control circuitry to indicate that the tone generator assigned to the particular note is now released.

The envelope amplitude information for each tone generator is stored in an Amplitude register 15 described in the above-identified pending application Ser. No. 652,217 on the ADSR envelope generator. The amplitude data for each word as it is read out of register 15 either remains the same or is modified and returned to the input of the Amplitude register 15 through an Amplitude Select gate 26, all as described in detail in the above-identified application on the ADSR envelope generator. The amplitude data at the output of the gate 26 is applied to the Zero Detect circuit 218 through an AND gate 224 for every note not subject to the Sustained Repeat function. This latter condition is sensed by connecting the second input to the AND gate 224 to the output of the AND gate 204 through an inverter 226. The data stored in the Release Slope register 200 is used to gradually reduce the overall amplitude of the repeated notes during a sustained interval following release of the associated key.

From the above description it will be recognized that the release slope, that is, the rate at which the peak amplitudes of the repeat notes are reduced to zero, is determined by the frequency of the Repeat clock 216 and the value N of the Subtract circuit 212. The slope data stored in the register 200 controls the overall amplitude of each note by converting it to an analog voltage using an analog-to-digital converter 228. The output voltage of the converter 228 in turn is used to control the output level of a digital-to-analog converter 104 to which the ADSR envelope is applied. The output of the digital-to-analog converter 104, in the manner described in connection with FIG. 7 of the above-identified application Ser. No. 603,776 on the polyphonic tone synthesizer, in turn controls a digital-to-analog converter 98 to which the waveform data from the tone generators is converted to an analog voltage applied to the sound system 100 of the instrument. Each digital-to-analog converter operates in effect as an amplitude modulator.

From the above-description it will be seen that a digital circuit is provided which is able to control the rate at which the amplitude of the envelope of one or more notes can be gradually reduced to zero to provide a sustained effect on repetitive notes generated by actuation of a single key.

What is claimed is:

1. In a polyphonic tone synthesizer in which a plurality of different tones are generated, using a plurality of tone generators, in response to activating keys on a keyboard by generating and storing a separate control word in a register in response to each key that is actuated, the control word having bits identifying the particular key, each control word being assigned to a tone generator when the particular key is depressed for controlling the pitch of the tone generated by the tone generator in response to the bits identifying the key, apparatus comprising: means responsive to actuation of a key for setting a group of bits in the control word associated with the particular key in the register to an initial value, means responsive to release of a key for periodically decrementing the value of said group of bits in the control word in the register associated with the particular key, and amplitude control means responsive to said group of bits in the control word for controlling the peak amplitude of the tone generated by the tone generator assigned to the control word when the particular key was actuated, said means reducing the amplitude as the value of said group of bits is decremented.

2. Apparatus of claim 1 wherein said amplitude control means includes a digital-to-analog converter for converting the value of said group of bits to an analog signal, and means responsive to said analog signal for attenuating the tone from the assigned tone generator in proportion to the magnitude of the analog signal.

3. Apparatus of claim 2 wherein said decrementing means includes a clock for controlling the decrementing frequency and means for controlling the amount the value of said group of bits is decremented.

4. Apparatus of claim 1 further including means for presetting the magnitude of the decrementing means to control the rate at which a released note is reduced to zero amplitude.

* * * * *